US008116669B2

(12) United States Patent
Sato et al.

(10) Patent No.: US 8,116,669 B2
(45) Date of Patent: Feb. 14, 2012

(54) IMAGE FORMING APPARATUS AND ELECTRIC DISCHARGE DEVICE

(75) Inventors: Noriaki Sato, Suntou-gun (JP); Masatake Usui, Susono (JP); Hideki Hashimoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 771 days.

(21) Appl. No.: 12/256,978

(22) Filed: Oct. 23, 2008

(65) Prior Publication Data

US 2009/0110447 A1 Apr. 30, 2009

(30) Foreign Application Priority Data

Oct. 24, 2007 (JP) ..... 2007-276407

(51) Int. Cl.
*G03G 15/14* (2006.01)

(52) U.S. Cl. ..... 399/315; 399/310; 399/400

(58) Field of Classification Search ..... 399/310, 399/315, 400

See application file for complete search history.

(56) References Cited

U.S. PATENT DOCUMENTS

| | | | | |
|---|---|---|---|---|
| 4,958,194 | A * | 9/1990 | Kaieda et al. | 399/312 |
| 5,250,992 | A | 10/1993 | Tsuneeda et al. | |
| 5,253,017 | A * | 10/1993 | Takeda | 399/89 |
| 6,952,548 | B2 | 10/2005 | Uchida | |

FOREIGN PATENT DOCUMENTS

| | | |
|---|---|---|
| JP | 04-14995 | 1/1992 |
| JP | 04-208955 | 7/1992 |
| JP | 58-186762 | 10/1993 |
| JP | 07-175344 | 7/1995 |
| JP | 2000-206802 | 7/2000 |
| JP | 2004-004335 | 1/2004 |

* cited by examiner

*Primary Examiner* — David Gray
*Assistant Examiner* — Roy Y Yi
(74) *Attorney, Agent, or Firm* — Canon U.S.A., Inc., IP Division

(57) ABSTRACT

An image forming apparatus includes a diode for restraining deterioration of an electric discharge device caused when a voltage applied to a discharge electrode and a shield electrode is switched. By switching the voltage at only one position using the diode, both of the voltage applied to the discharge electrode and the voltage applied to the shield electrode can be switched simultaneously.

6 Claims, 10 Drawing Sheets

IMAGE FORMING APPARATUS AND ELECTRIC DISCHARGE DEVICE

BACKGROUND OF THE INVENTION

1. Field of the Invention

The present invention relates to an image forming apparatus having an image forming process unit employing an appropriate method such as electrophotography, electrostatic recording or magnetic recording. More specifically, the present invention relates to an image forming apparatus, which forms a toner image on a surface of a transfer material.

2. Description of the Related Art

Conventionally, an image forming apparatus, such as a copying machine or a printer, employs an electrophotographic method. In the electrophotographic system, a toner image is formed on a transfer material such as a paper by toner particles using an electrostatic force, melted and fixed on the transfer material by heat and pressure applied by a fixing device, and discharged as an output image. In recent years, image forming apparatuses employing the electrophotographic method have improved functionalities such as color imaging function and high-speed processing. Under the circumstances, a color image forming apparatuses employing a tandem system that is excellent in functionality are widely used. A conventional configuration described below also employs the tandem system.

FIG. 7 illustrates a schematic diagram of a color image forming apparatus employing the tandem system. In the tandem system color image forming apparatus, toner image forming units 1*a*, 1*b*, 1*c* and 1*d* for colors of cyan, magenta, yellow, black are independently arranged. A transfer material S such as a paper and an overhead projector (OHP) sheet is conveyed by an electrostatic conveying belt 7 made from a resin material that is stretched by a driving roller 8 and a driven roller 9, and sequentially passes through the respective toner image forming units 1*a*, 1*b*, 1*c* and 1*d*. Each time the transfer material S passes through the toner image forming unit, each color toner image is superimposed on the other color toner images on the transfer material S to form a full-color toner image on the transfer material S. The image forming processing will be described in more detail below. Since internal operations of the respective toner image forming units are almost the same, only the operation of the toner image forming unit 1*a* for cyan will be described on behalf of all colors. In the toner image forming unit 1*a*, a photosensitive drum 2*a* that is driven to rotate in an arrowed direction is, first, uniformly charged to a negative potential by a photosensitive drum charger 3*a* and a latent image corresponding to a cyan image is formed on the surface by a scanning light from a laser exposure optical system 4*a*. A given amount of negatively charged cyan toner is supplied onto a developing roller 5*a*, and a developing bias is applied to the developing roller 5*a*. The developing bias is set to an appropriate value between a potential of a uniformly charged portion and a potential of an exposed latent image portion so that the toner can selectively adhere to the latent image on the photosensitive drum 2*a* and be developed.

The cyan toner image formed on the photosensitive drum 2*a* is electrostatically transferred onto the transfer material S by a transfer bias of positive polarity opposite to the charged polarity of the toner applied to a transfer roller 14*a*. The transfer material S is conveyed at an approximately same speed as the photosensitive drum 2*a* in a close contact with the electrostatic conveying belt 7.

The toner remaining on the photosensitive drum 2*a* that has not been transferred is scraped off by a cleaning blade 6*a* and collected into a waste toner container (not illustrated).

The above-described process is performed by each of the toner image forming units (1*b*, 1*c*, and 1*d*) for yellow, magenta and black. When a full-color unfixed toner image is formed on the transfer material S, the transfer material S is separated from the electrostatic conveying belt 7 and is guided to a fixing device 18.

In the fixing device 18, the transfer material S passes through a pressure contact portion (fixing nip) between a fixing roller and a pressure roller, where the unfixed toner image is melted and fixed on the transfer material S by heat and pressure as an output image of the apparatus.

An attraction roller 12 assists in attracting the transfer material S onto the electrostatic conveying belt 7. A voltage of positive polarity is applied to the attraction roller 12. The transfer material S supplied from a sheet feeder 16 passes between the electrostatic conveying belt 7 and the attraction roller 12. As a consequence, electrostatic polarization between the transfer material S and the electrostatic conveying belt 7 is promoted, thus attracting the transfer material S onto the electrostatic conveying belt 7.

The transfer material S retained by the electrostatic conveying belt 7 sequentially passes through image forming stations for respective colors and each time the transfer material S undergoes a transfer process, the transfer material S receives many charges on its surface. As a result, the transfer material S after the transfer process is in a strongly charged state and separating discharge occurs when the transfer material S is separated from the electrostatic conveying belt 7 which may disturb an unfixed toner image on the transfer material S.

To solve the foregoing problems, an electric discharge device is provided at a separating position of the electrostatic conveying belt. The transfer material is separated from the electrostatic conveying belt to discharge the transfer material to an appropriate level as discussed, for example, in Japanese Patent Application Laid-Open No. 2004-004335 and Japanese Patent Application Laid-Open No. 2000-206802.

The electric discharge device disposed at the transfer material separation position of the electrostatic conveying belt includes a discharge electrode and a shield electrode that is a conductive member for assisting electric discharge of the discharge electrode. When a voltage of a threshold value or higher to the discharge electrode is applied, electric discharge is generated between the discharge electrode and the shield electrode to remove excessive charges from the transfer material, thus occurrence of the separating discharge is prevented. However, deterioration of the discharge electrode may be accelerated if the electric discharge device continuously generates electric discharge between the discharge electrode and the shield electrode. Accordingly, an electric discharge operation of the electric discharge device is stopped between paper sheets during image formation or under a condition where an amount of charge of the transfer material is prone to decrease. Stopping the electric discharge device can prevent acceleration of the deterioration of the discharge electrode. The amount of charge of the transfer material is prone to decrease in a high-humidity environment.

However, if the image formation is performed while the operation of the electric discharge device is stopped, the toner may adhere to and soil the electric discharge device. More specifically, negatively charged toner is attracted by mirror image charges of positive polarity induced by the shield electrode or the discharge electrode which has a ground potential in a voltage OFF state and come flying to adhere to the electric discharge device.

While the electric discharge device generates electric discharge between the discharge electrode and the shield electrode, soiling is less likely to occur even though a voltage of positive polarity which is more prone to attract the toner is applied to the discharge electrode. This is because the electric discharge generated between the discharge electrode and the shield electrode enables ion molecules which are much lighter than toner particles swiftly to reach and discharge the toner on the transfer material.

As a measure against soiling of the electric discharge device, a structure can be considered in which a voltage of the same polarity as a charge polarity of the toner is independently applied to each of the discharge electrode and the shield electrode while the operation of the electric discharge device is stopped to prevent the toner from adhering to the electric discharge device. Such a structure is illustrated in FIG. 8.

The structure shown in FIG. 8 includes a discharge electrode 55 and a shield electrode 53 which is a flat-shaped conductive member. A power circuit 56 capable of applying voltages of both positive and negative polarities is connected to the discharge electrode 55. More specifically, the power circuit 56 is connected to a terminal 58 to apply a voltage of negative polarity, and to a terminal 59 to apply a voltage of positive polarity. Further, a power circuit 57 capable of applying a voltage of negative polarity is connected to the shield electrode 53.

During an operation (electric discharge operation) of the electric discharge device, a voltage of +4 kV is applied to the discharge electrode 55 and the shield electrode 53 is set OFF (0 V) to accelerate discharge between the discharge electrode 55 and the shield electrode 53 so that ions are supplied. When the electric discharge operation is not performed (discharge OFF state), a voltage of −1 kV is applied to both of the discharge electrode 55 and the shield electrode 53 to prevent adhesion of the toner.

By applying a voltage of the same polarity as the charge polarity of the toner to both of the discharge electrode 55 and the shield electrode 53 as described above when the electric discharge operation is not performed, soiling of the electric discharge device can be reduced.

The above-mentioned operations may be summarized in the following table 1.

TABLE 1

| | During electric discharge operation | During electric discharge OFF |
|---|---|---|
| Discharge electrode (output from power circuit 56) | 4 kV | −1 kV |
| Shield electrode (output from power circuit 57) | 0 kV | −1 kV |

However, in the structure that soiling of the electric discharge device can be reduced by applying a voltage of the same polarity as the charge polarity of the toner to both of the discharge electrode 55 and the shield electrode 53 when the electric discharge operation is not performed, a relationship of potentials between the power circuit 56 of the discharge electrode 55 and the power circuit 57 of the shield electrode 53 is considered to vary from a state illustrated in Table 1.

This is because separate output switches are provided for the power circuit 56 of the discharge electrode 55 and the power circuit 57 of the shield electrode 53 which causes a little time lag of output values when the electric discharge operation is switched to the discharge OFF state and vice versa.

FIGS. 9A and 9B illustrate a state of voltage switching of a discharge electrode (illustrated by solid line) and a shield electrode (illustrated by a broken line). FIG. 9A illustrates a case where a voltage applied to the discharge electrode is switched earlier than that applied to the shield electrode. FIG. 9B illustrates a case where the voltage applied to the shield electrode is switched earlier than that applied to the discharge electrode.

In a region P2, a potential difference between the discharge electrode and the shield electrode is larger than 4 kV which is a value during an ordinary electric discharge operation. In such a state, a discharge current increases and deterioration of the discharge electrode accelerates. On the other hand, in a region P1, the potential of the discharge electrode is lowered earlier than that of the shield electrode. Periphery of the electric discharge device and a surface of the shield electrode may have a very small amount of soil and toner which is charged with a positive polarity due to positive discharge during the electric discharge operation. Accordingly, the toner and soil receive a force of an electric field in the region P1 to move toward and adhere to the discharge electrode.

Deterioration and soiling of the discharge electrode reduces discharge performance and causes image failure during separation of the transfer material. Moreover, a strong electric field force generated between the toner which has not been discharged and the discharge electrode may cause a white spot phenomenon in which a part of a toner image is drawn toward the discharge electrode and lost.

SUMMARY OF THE INVENTION

The present invention is directed to an image forming apparatus capable of restraining deterioration of an electric discharge device which is caused when switching a voltage applied to a discharge electrode and a voltage applied to a shield electrode (i.e., conductive member).

According to an aspect of the present invention, an image forming apparatus includes an image bearing member for bearing an unfixed toner image, a transfer unit configured to transfer the unfixed toner image onto a transfer material from the image bearing member, a fixing unit configured to fix the unfixed toner image on the transfer material, a conveying belt configured to convey the transfer material from the transfer unit to the fixing unit, and an electric discharge unit configured to perform electric discharge to the transfer material, wherein the electric discharge unit includes a discharge electrode, a power circuit capable of applying a voltage to the discharge electrode, and a conductive member disposed at a position opposed to the discharge electrode which is configured to assist electric discharge of the discharge electrode, and is provided on a side of a surface of the transfer material on which the unfixed toner image is carried, between the transfer unit and a position at which the transfer material separates from the conveying belt, wherein the power circuit is switchable between a voltage of positive polarity applied to the discharge electrode and voltage of negative polarity applied to the discharge electrode, and wherein the electric discharge unit further includes a first diode and a second diode, the conductive member is electrically grounded via the first diode, the discharge electrode and the conductive member are connected via the second diode, and terminals of the same polarity of the first diode and the second diode are connected to the conductive member.

According to another aspect of the present invention, an electric discharge device includes a discharge electrode, a power circuit capable of applying a voltage to the discharge electrode, and a conductive member which is disposed at a position opposed to the discharge electrode configured to assist electric discharge of the discharge electrode, wherein the power circuit is switchable between a voltage of positive polarity applied to the discharge electrode and a voltage of negative polarity applied to the discharge electrode, and wherein the electric discharge device further includes a first diode and a second diode, the conductive member is electrically grounded via the first diode, the discharge electrode and the conductive member are connected via the second diode, and terminals of the same polarity in the first diode and the second diode are connected to the conductive member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 1:
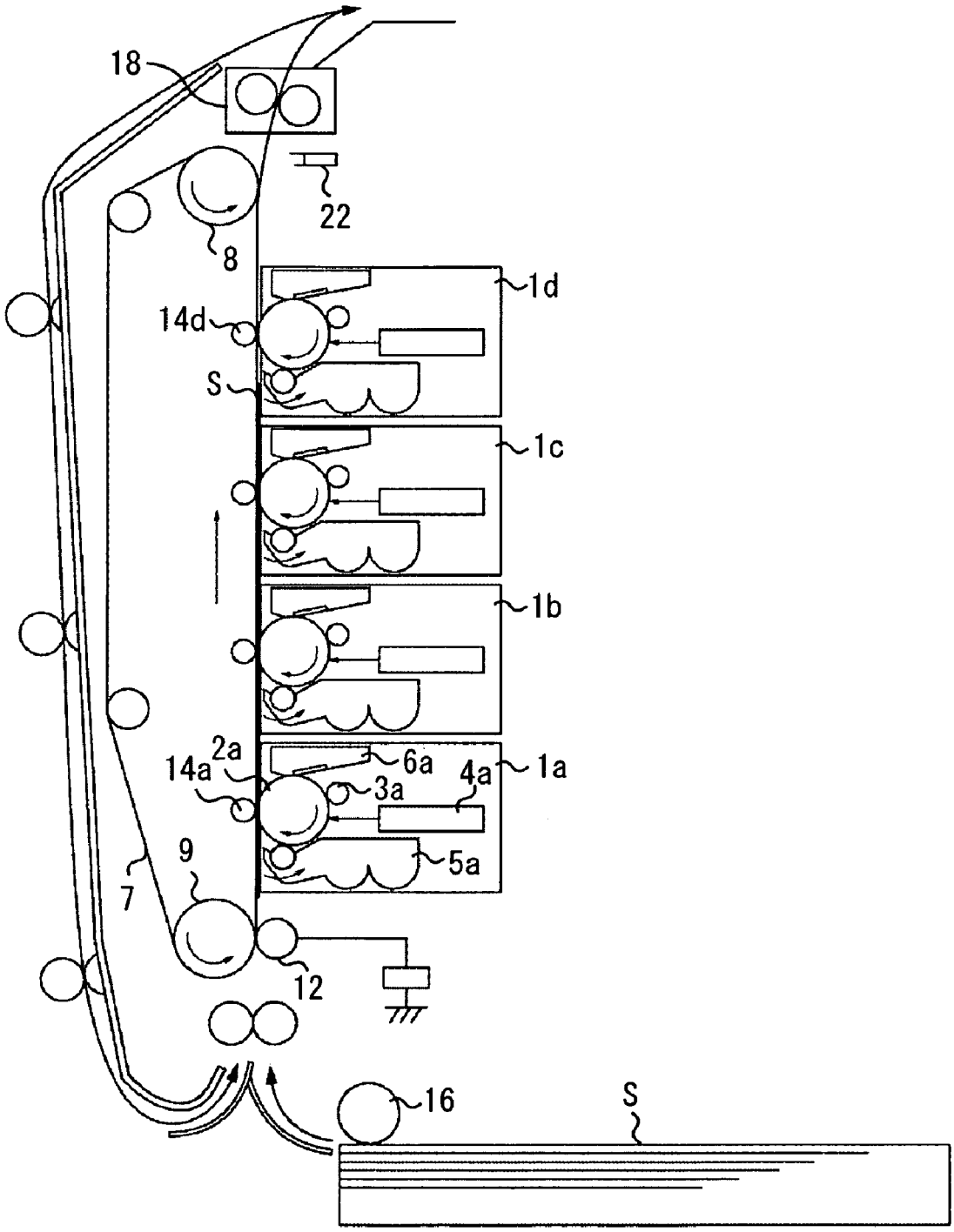
FIG. 1 illustrates an example of a structure of an image forming apparatus according to a first exemplary embodiment of the present invention.

FIG. 1 illustrates an example of a structure of a color image forming apparatus employing a tandem system according to a first exemplary embodiment of the present invention. In the tandem system color image forming apparatus, toner image forming units 1*a*, 1*b*, 1*c* and 1*d* for cyan, magenta, yellow, and black, respectively, are arranged. A transfer material S such as a paper and an OHP sheet is conveyed by an electrostatic conveying belt 7 stretched by a driving roller 8 and a driven roller 9 and sequentially passes through each of the toner image forming units 1*a*, 1*b*, 1*c* and 1*d*. Each time the transfer material S passes through the toner image forming unit, each color toner image is superimposed upon the other color toner images on the transfer material S to form a full-color unfixed toner image. Image formation will be described in more detail below. Since internal operations of the respective toner image forming units are almost the same, only the operation of the toner image forming unit 1*a* for cyan will be described on behalf of all colors.

The toner image forming unit 1*a* includes a photosensitive drum 2*a* (image bearing member) rotating at a surface speed of 180 mm/s in an arrowed direction. The photosensitive drum 2*a* is uniformly charged to −500 V by a charging device 3*a*. A surface of the charged photosensitive drum 2*a* is exposed to a scanning light from a laser exposure optical system 4*a* and a latent image is formed on the drum. A potential of the latent image portion formed by the exposure to the scanning light is approximately −200 V. Next, a developing roller 5*a* to which a developing bias is applied develops a cyan toner image corresponding to the latent image on the surface of the photosensitive drum 2*a*.

A transfer roller 14*a* which is a transfer unit is disposed on a back side of the electrostatic conveying belt 7, and the cyan toner image formed on the photosensitive drum 2*a* is transferred onto the transfer material S by the transfer roller 14*a*. During a transfer operation, a transfer bias of +1300 V is applied to the transfer roller 14*a*. The cyan toner remaining on the photosensitive drum 2*a* without being transferred to the transfer material S is collected by a cleaning blade 6*a*.

When the above processes are further performed for each of yellow, magenta and black (1*b*, 1*c*, 1*d*) and thus a full color unfixed toner image is formed on the transfer material S, the transfer material S is separated from the electrostatic conveying belt 7 at a position of the driving roller 8 and is guided to a fixing device 18. An electric discharge device 22 is provided on a side of the transfer material S carrying the unfixed toner image. The electric discharge device 22 performs electric discharge for the transfer material S between a transfer roller 14*d* for black which is the transfer unit that the transfer material S lastly passes through, and a position where the transfer S is separated from the electrostatic conveying belt 7.

The transfer material S which has been electrically-discharged by the electric discharge device 22 is separated from the electrostatic conveying belt 7 and enters the fixing device 18 to be fixed. In the fixing apparatus 18, the unfixed toner image on the transfer material S is melted and fixed on the transfer material S and is discharged from the image forming apparatus.

The electrostatic conveying belt 7 is made of a resin material having resistance to belt elongation, deformation and fracture due to long-term use and whose electrical resistance is adjusted before use. In the present exemplary embodiment, there is used a single-layer belt made of polyimide resin with 70 μm in thickness and 600 mm in circumferential length whose volume resistance value is adjusted to approximately $1.0\times10^{8}$ Ωcm by dispersing carbon particles. As a material of the electrostatic conveying belt 7, for example, a resin film of polyvinylidene fluoride (PVdF) resin, tetrafluoroethylene-ethylene copolymer (ETFE) resin, polyethylene terephthalate (PET) and polycarbonate may be used.

The transfer roller 14*a* is made of epichlorohydrin rubber with a diameter of 12 mm whose volume resistance value is adjusted to $1.0\times10^8$ Ωcm and is in contact with a nip portion formed between the transfer roller 14*a* and the photosensitive drum 2*a* at a total transferring pressure of 2.94 N from a rear surface of the electrostatic conveying belt 7.

The transfer material S such as paper fed from a sheet feeding mechanism 16 passes through an attraction roller 12, shown in FIG. 1, when the transfer material S is introduced into the electrostatic conveying belt 7. The attraction roller 12 is applied with a voltage of +1000 V and electrostatic polarization between the transfer material S and the electrostatic conveying belt 7 is promoted by an electric field and charge supply that is generated by the applied voltage so that the transfer material S is attracted onto the electrostatic conveying belt 7.

The attraction roller 12 is a solid rubber roller of 12 mm in diameter made of ethylene propylene methylene linkage in which carbon black is dispersed for resistance adjustment and is configured to apply high voltage for attraction to a core metal. A resistance value of the attraction roller 12 is adjusted to $1\times10^6$Ω when a metal foil 1 cm wide is wound around an outer periphery of the attraction roller 12 and a voltage of 500 V is applied between the foil and the metal core.

Figure 2:
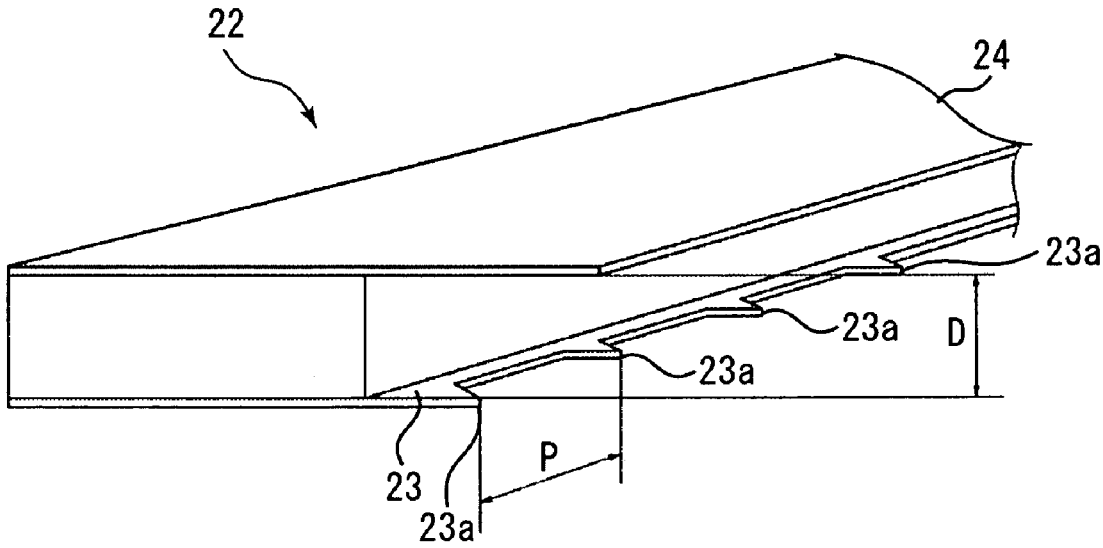
FIG. 2 illustrates an example of a structure of an electric discharge device according to the first exemplary embodiment.

Next, the electric discharge device 22 according to the present exemplary embodiment will be described below. The electric discharge device according to the present exemplary embodiment includes a discharge electrode 23 with a serrated shape having needle-like protrusions linearly arranged at predetermined intervals P as illustrated in FIG. 2. Moreover, the electric discharge device 22 includes a shield electrode 24 which is disposed near the discharge electrode 23 at a distance D and serves as a conductive member for assisting and promoting electric discharge.

The discharge electrode 23 is made of stainless steel 100 μm thick and molded by precision press processing. A curvature R of a needle tip 23*a* is R=30 μm or less and the interval P between the needle tips 23*a* is P=8 mm. The shield electrode 24 is a stainless steel plate 0.5 mm thick. An end face of the plate is rounded so as to have no sharp edge of burr. The distance D between the discharge electrode 23 and the shield electrode 24 is approximately 4 mm.

In the electric discharge device 22 illustrated in FIG. 2, the electric discharge starts when a potential difference between the discharge electrode 23 and the shield electrode 24 is at least 3.3 kV and a discharge current of approximately 50 μA flows at the potential difference of 4.0 kV. The electric discharge is generated between the discharge electrode 23 and the shield electrode 24, and generated ions are applied to an opposing position of the electric discharge device 22.

Figure 3:
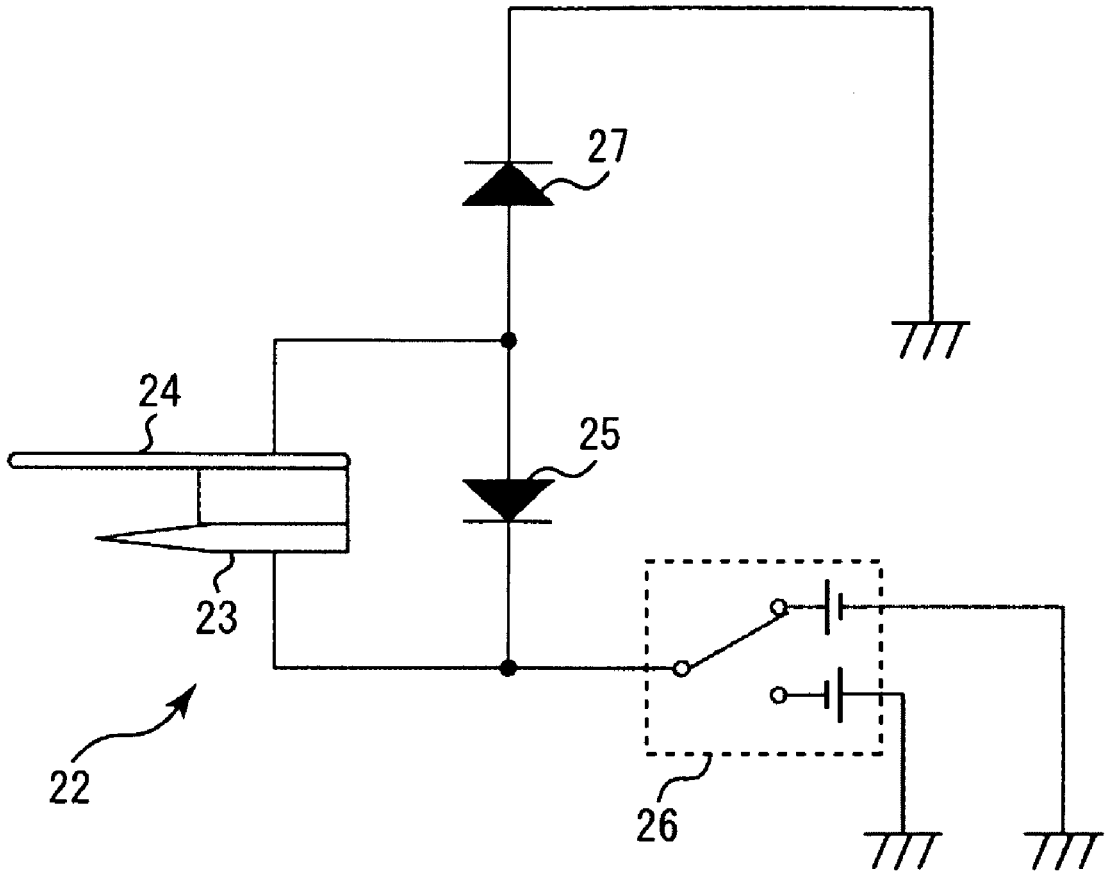
FIG. 3 illustrates an example of a circuit configuration of the electric discharge device according to the first exemplary embodiment.

Next, referring to FIG. 3, a circuit configuration of the electric discharge device 22 according to the present exemplary embodiment will be described below. In the present exemplary embodiment, the shield electrode 24 is grounded via a diode 27 (first diode) and the discharge electrode 23 and the shield electrode 24 are connected with each other via a diode 25 (second diode). The diode 27 and the diode 25 are electric elements having a rectification function. A terminal on an anode side of the diode 27 is connected with the shield electrode 24. A power circuit 26 capable of applying a voltage to the discharge electrode 23 is connected thereto. Further, the power circuit 26 can switch between a state in which a voltage of positive polarity is applied to the discharge electrode 23 and a state in which a voltage of negative polarity is applied to the discharge electrode 23. The diode 25 as a rectification element is disposed between the discharge electrode 23 and the shield electrode 24, and an anode-side terminal of the diode 25 is connected to the shield electrode 24. Accordingly, not positive charges (charges with polarity applied to the discharge electrode 23 when the electric discharge device 22 is operated) but negative charges flow into the shield electrode 24 from the discharge electrode 23. Because the shield electrode 24 is grounded via the diode 27, not negative charges but positive charges flow from the shield electrode 24 into the ground.

Next, operations are described below when the electric discharge operation is performed and when only the voltage of negative polarity is applied without performing the electric discharge (during discharge OFF state).

When the electric discharge operation is performed, a voltage of 4 kV is applied to the discharge electrode 23. The diode 25 may be configured with a high-voltage diode having a reverse breakdown voltage of 4 kV or more, or a plurality of diodes connected in series so that the reverse breakdown voltage is 4 kV or more. With this configuration, only the discharge current flows from the discharge electrode 23 into the shield electrode 24. On the other hand, since the shield electrode 24 can release positive charges received by the electric discharge into the ground, the shield electrode 24 can be kept at a potential of 0 V, and the electric discharge can be generated between the discharge electrode 23 and the shield electrode 24.

Figure 8:
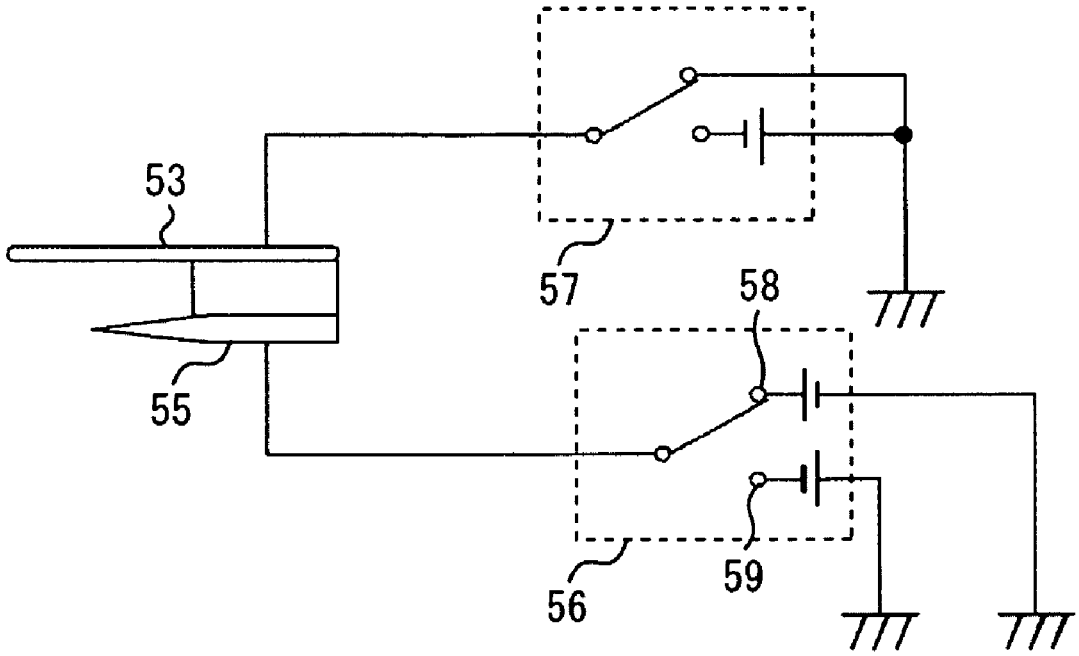
FIG. 8 PRIOR ART
FIG. 8 illustrates an example of a circuit configuration of a conventional electric discharge device which can apply a voltage to both a discharge electrode and a shield electrode switching between positive polarity and negative polarity.

When the electric discharge is OFF (voltage of negative polarity is applied), a voltage of −1 kV is applied to the discharge electrode 23 by a negative voltage of the power circuit 26. Negative charges pass through the diode 25 and reach the shield electrode 24, but do not flow into the ground due to the presence of the diode 27. As a result, a potential of the shield electrode 24 is also kept at −1 kV and, like the structure illustrated in FIG. 8, soiling of toner is prevented from adhering to the device. At this time, the diode 27 having a reverse breakdown voltage of 1 kV or more is used.

The above-mentioned operations may be summarized as follows.

TABLE 2

| | During electric discharge operation | During electric discharge OFF |
|---|---|---|
| Discharge electrode (output from power circuit 26) | 4 kV | −1 kV |
| Shield electrode | 0 V | −1 kV |

Figure 9A:
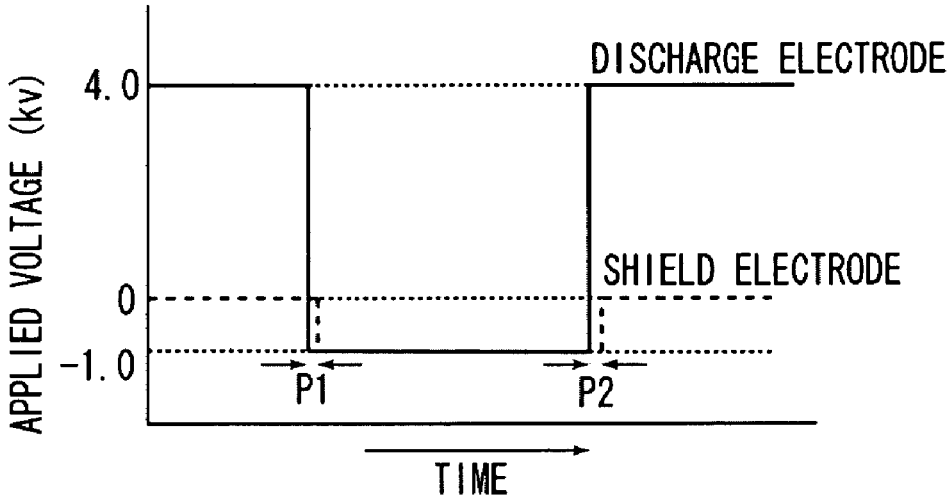
FIG. 9A PRIOR ART
FIGS. 9A and 9B illustrate a switching state of voltages applied to the discharge electrode and the shield electrode.
Figure 9B:
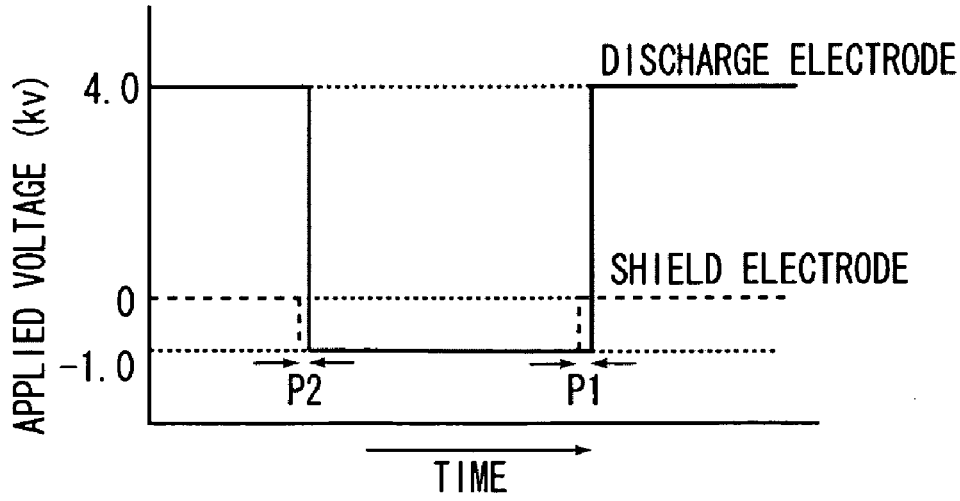
FIG. 9B PRIOR ART

As described above, the present exemplary embodiment is configured such that voltage is switched only by the power circuit 26 of the discharge electrode 23 when an ON/OFF operation of the electric discharge is performed, and the potential of the shield electrode 24 is determined according to the voltage applied to the discharge electrode 23. Accordingly, the lag of the voltage switching timing illustrated in FIGS. 9A and 9B is not generated between the discharge electrode 23 and the shield electrode 24. As a result, an excessive potential difference or reverse phenomenon of a potential difference does not occur between the discharge electrode 23 and the shield electrode 24, and deterioration and soiling of the discharge electrode 23 can be prevented.

In the present exemplary embodiment, by connecting the discharge electrode 23 and the shield electrode 24 of the electric discharge device 22 via an electric element, the voltage of negative polarity applied by the power circuit 26 can be distributed to both the electrodes and one power circuit can be shared.

As described above, in the present exemplary embodiment, the discharge electrode 23 and the shield electrode 24 are connected with each other via the electric element (the diode 25) having the rectification function, and the voltage of the shield electrode 24 is determined according to the voltage applied to the discharge electrode 23. This configuration can prevent generation of the lag of the voltage switching timing between the discharge electrode 23 and the shield electrode 24, as a result, the deterioration of the discharge electrode 23 can be prevented. In addition, the configuration of the present exemplary embodiment allows applying the voltage only from the power circuit 26 to both of the discharge electrode 23 and the shield electrode 24, thus a number of the power circuits can be reduced.

Figure 10:
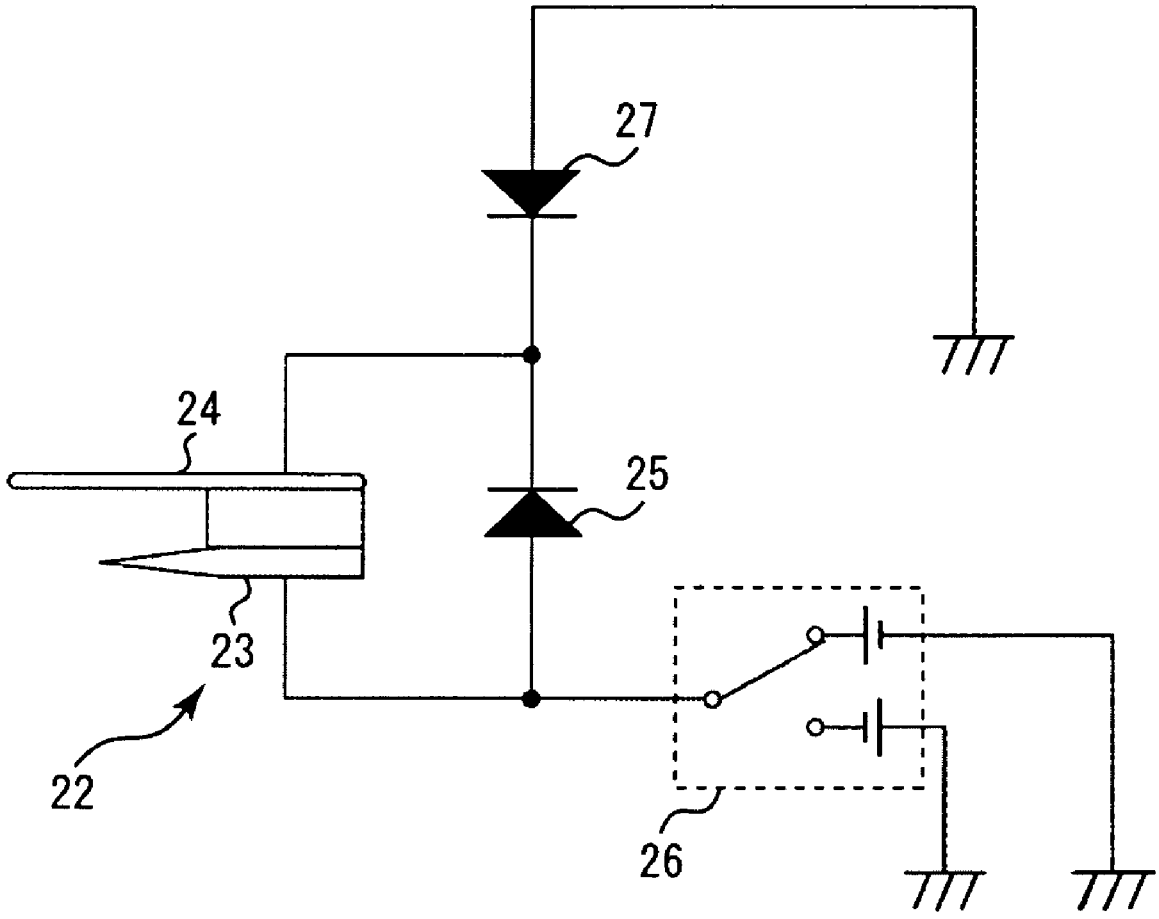
FIG. 10 illustrates an example of a circuit configuration of an electric discharge device according to a modified example of the first exemplary embodiment.

In order to prevent the separating discharge in the transfer material which carries positively charged toner, the present exemplary embodiment may be modified, for example, by connecting a cathode terminal of the diode 27 with a cathode terminal of the diode 25, as illustrated in FIG. 10. Further, by applying a voltage of −4 kV to the discharge electrode 23, the electric discharge is generated between the discharge electrode 23 and the shield electrode 24. During the electric discharge is OFF, the voltage of 1 kV is applied to the discharge electrode 23, thus the discharge electrode 23 and the shield electrode 24 are kept at the potential of positive polarity.

Second Exemplary Embodiment

In a second exemplary embodiment, a discharge electrode and a shield electrode of an electric discharge device are connected via a resistive element. Further, the shield electrode is grounded via a rectification element and the voltage of the shield electrode is determined according to the voltage applied to the discharge electrode.

Figure 4:
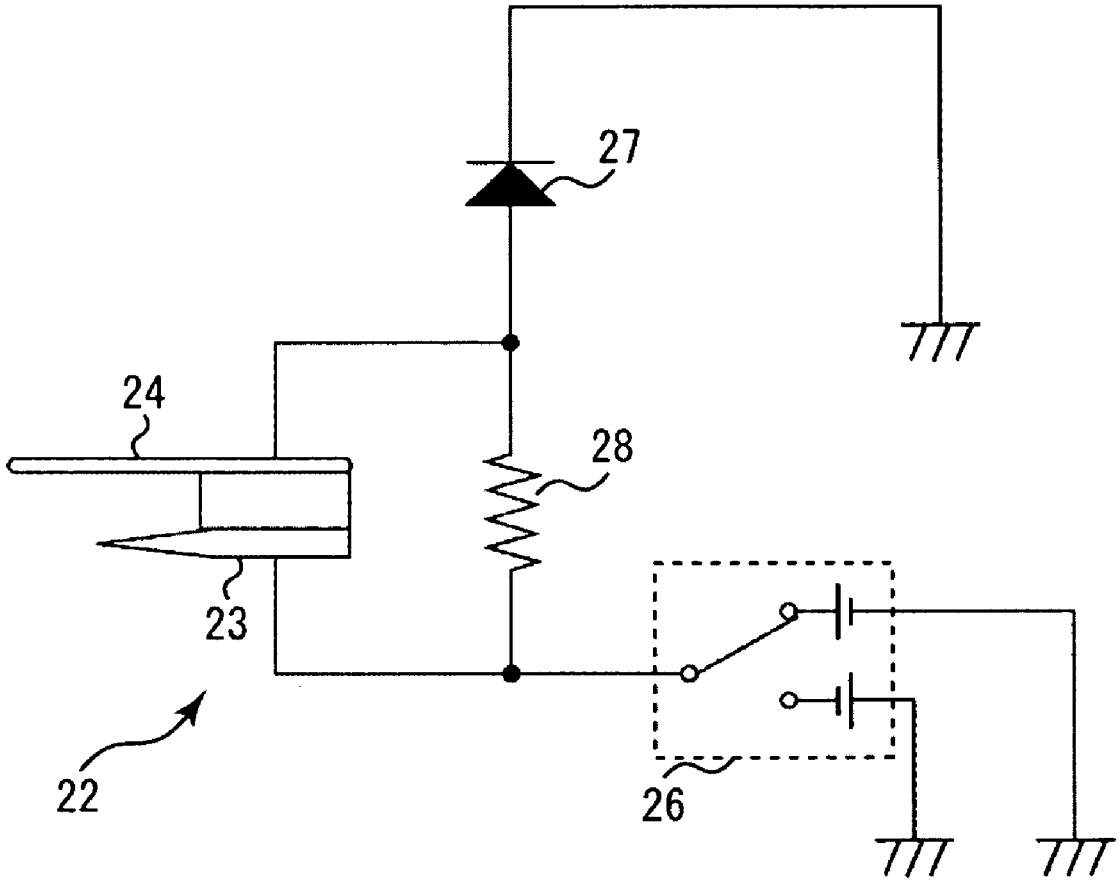
FIG. 4 illustrates an example of a circuit configuration of an electric discharge device according to a second exemplary embodiment of the present invention.

FIG. 4 illustrates a configuration of the electric discharge device according to the second exemplary embodiment. The present exemplary embodiment is similar to the first exemplary embodiment except that an electric element which connects the discharge electrode 23 and the shield electrode 24 is a resistive element 28.

The operations of the electric discharge device in the present exemplary embodiment are as follows.

During the electric discharge operation, a voltage of +4 kV is applied to the discharge electrode 23 by the power circuit 26, so that the electric discharge device emits positive ions. A part of positive charges flow to the shield electrode 24 via the resistive element 28. In the present exemplary embodiment, an amount of positive charges flowing to the shield electrode 24 is set to 8 μA by using the resistive element 28 with high resistance like 500 MΩ. The current amount 8 μA is sufficiently small as compared to the discharge current (50 μA) and does not become a load on the power circuit 26.

Similar to the first exemplary embodiment, when the electric discharge is OFF, a voltage of −1 kV is applied to the discharge electrode 23 and negative charges flow into the shield electrode 24 via the resistive element 28. However, the diode 27 blocks the negative charges flowing into the ground. Hence, a voltage drop due to the resistive element 28 is eliminated and the shield electrode 24 is kept at −1 kV, which is the same voltage as that of the discharge electrode 23.

The above-mentioned operations may be summarized as follows.

TABLE 3

| | During electric discharge operation | During electric discharge OFF |
|---|---|---|
| Discharge electrode (output from power circuit 26) | 4 kV | −1 kV |
| Shield electrode | 0 V | −1 kV |

More specifically, the present exemplary embodiment can perform the operations similar to the first exemplary embodiment. Further, the ON/OFF operation of the electric discharge is performed only by the power circuit 26 and therefore deterioration and soiling of the discharge electrode 23 can be prevented. By connecting the discharge electrode 23 with the shield electrode 24 via an electric element (resistive element) 28, the voltage of negative polarity applied to the discharge electrode 23 can be distributed to both of the discharge electrode 23 and the shield electrode 24 similar to the first exemplary embodiment.

As described above, according to the present exemplary embodiment, the discharge electrode and the shield electrode of the electric discharge device are connected with each other via the resistive element and the voltage of the shield electrode is determined according to the voltage applied to the discharge electrode. Accordingly, deterioration of the discharge electrode can be prevented and one power circuit can be shared similar to the first exemplary embodiment and cost can be reduced.

Third Exemplary Embodiment

In a third exemplary embodiment, a discharge electrode is connected with a shield electrode via an electric element (resistive element). However, the third exemplary embodiment is different from the first and the second exemplary embodiments in that a power circuit for supplying a discharge voltage and a power circuit for applying a voltage of opposite polarity are disposed at different positions.

Figure 5:
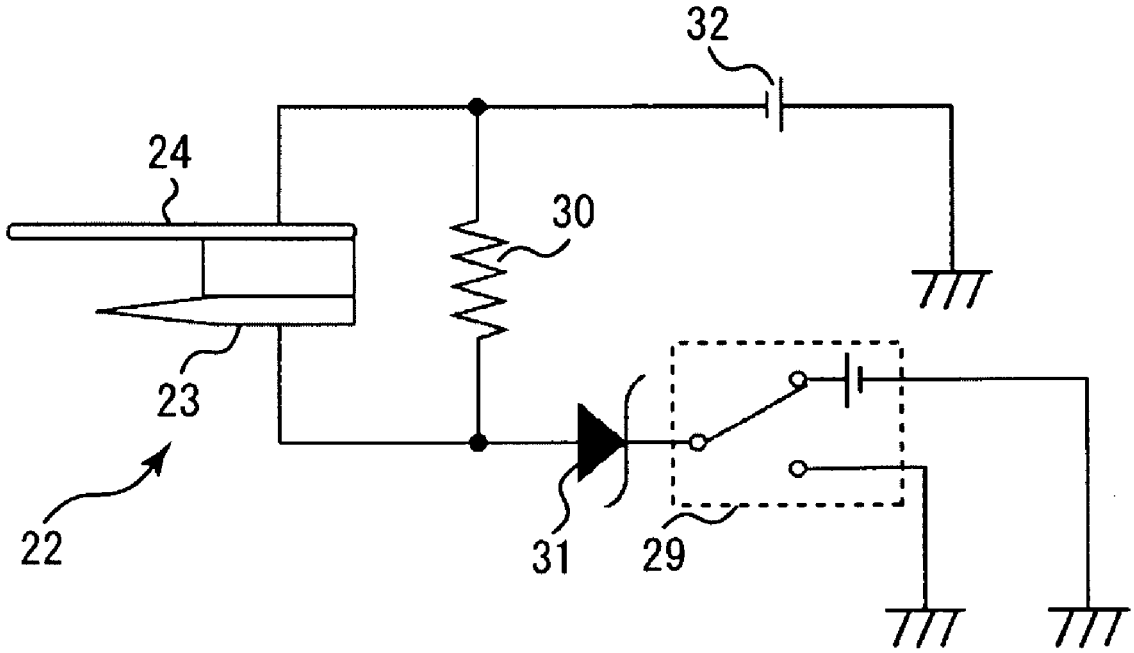
FIG. 5 illustrates an example of a circuit configuration of an electric discharge device according to a third exemplary embodiment of the present invention.

FIG. 5 illustrates a circuit configuration of an electric discharge device according to the present exemplary embodiment. In the present exemplary embodiment, a power circuit 29 (first power circuit) capable of applying a voltage to the discharge electrode 23 is switchable between a state in which a voltage of positive polarity is applied to the discharge electrode 23 and a state in which the voltage of positive polarity is not applied to the discharge electrode 23. A constant voltage diode (Zener diode) 31 is connected between the discharge electrode 23 and the power circuit 29 (first power circuit) in a direction that an inverse voltage occurs when a discharge current flows.

In addition, a power circuit 32 (second power circuit) which applies the voltage of opposite polarity to the power circuit 29 is connected to the shield electrode 24, and further a resistive element 30 is connected between the discharge electrode 23 and the shield electrode 24.

A resistance value R2 of the resistive element 30 is 500 MΩ and a Zener voltage Vz1 of the constant voltage diode 31 is 1.1 kV. As the constant voltage element, a varistor or the like may be used. In addition, a plurality of constant voltage diodes connected in series may be used for the constant voltage diode 31.

Next, operations when the electric discharge is performed and when only the voltage of negative polarity is applied without performing the electric discharge are described below.

During the electric discharge operation, the power circuit 29 outputs a voltage V3 of 4.1 kV and the power circuit 32 outputs a voltage V4 of −1 kV. Then, a voltage drop equivalent to the Zener voltage Vz1 occurs at a portion of the constant voltage element and the voltage drops to +3 kV at the discharge electrode 23. However, because the same potential difference of 4 kV as before is provided between the discharge electrode 23 and the shield electrode 24, the electric discharge is generated and a sufficient amount of positive ions can be supplied. The resistive element 30 functions similar to the resistive element 28 in the second exemplary embodiment.

While the electric discharge is OFF, only the power circuit 29 is turned off and the power circuit 32 continues to output a voltage of −1 kV. Then, negative charges reach the discharge electrode 23 via the resistive element 30, but the negative charges do not flow toward the power circuit 29 unless a potential difference across the constant voltage diode 31 becomes 1.1 kV and below. Accordingly, a current flow is blocked by the constant voltage diode 31, and there is no voltage drop of the resistive element 30. Therefore, a potential of the discharge electrode 23 is kept at the same level of −1 kV as the shield electrode 24.

The above-mentioned operations may be summarized as follows.

TABLE 4

| | During electric discharge operation | During electric discharge OFF |
|---|---|---|
| Output from power circuit 29 | 4.1 kV | 0 (OFF) |
| Discharge electrode | 3 kV | −1 kV |
| Shield electrode (output from power circuit 32) | −1 kV | −1 kV |

Further, a relationship between an applied bias and the Zener voltage of the constant voltage diode 31 can be summarized as follows:

$$|V4| \leqq |Vz1| \leqq |V3-V4|$$

With the above-described configuration, the present exemplary embodiment can perform the electric discharge operation similar to the first exemplary embodiment. By performing only ON/OFF operations of the power circuit 29 on a discharge electrode 23 side, the polarity of the discharge electrode 23 can be switched from a state of applying the voltage during the electric discharge operation to a state of applying the voltage of negative polarity. Therefore, no problem occurs regarding the lag of the voltage switching timing between the discharge electrode 23 and the shield electrode 24. Further, by connecting the discharge electrode 23 with the shield electrode 24 via an electric element, the voltage of negative polarity can be distributed to the both electrodes similar to the first exemplary embodiment.

As described above, according to the present exemplary embodiment, the discharge electrode and the shield electrode of the electric discharge device are connected with each other via an electric element (resistive element) and the voltage polarity of the discharge electrode is changed depending upon the ON/OFF state of the voltage applied to the discharge electrode. As a result, deterioration and soiling of the discharge electrode can be prevented. Further, a number of the power circuits can be reduced to only two, one for a positive power supply and one for a negative power supply, and cost can be reduced.

Other Exemplary Embodiments

Figure 6:
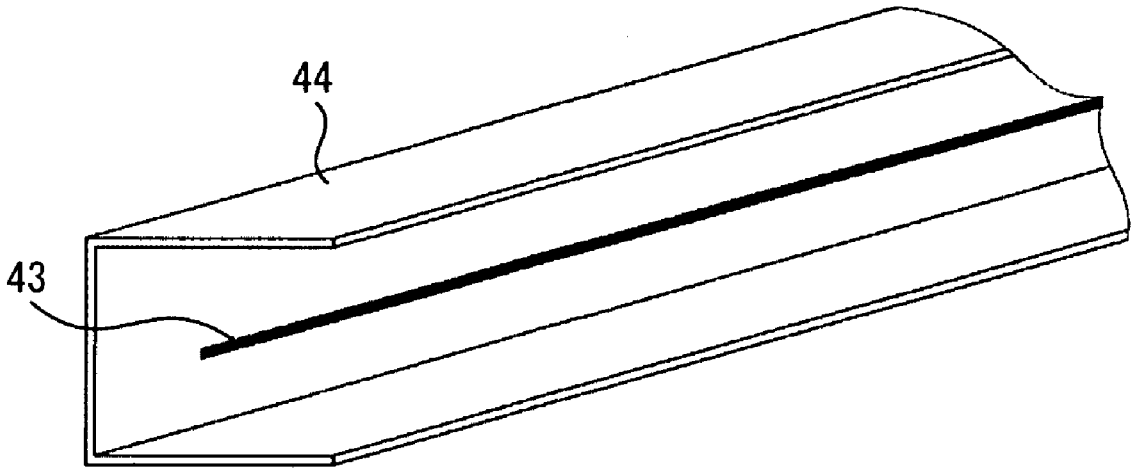
FIG. 6 illustrates an example of a structure of an electric discharge device according to another exemplary embodiment of the present invention.
Figure 7:
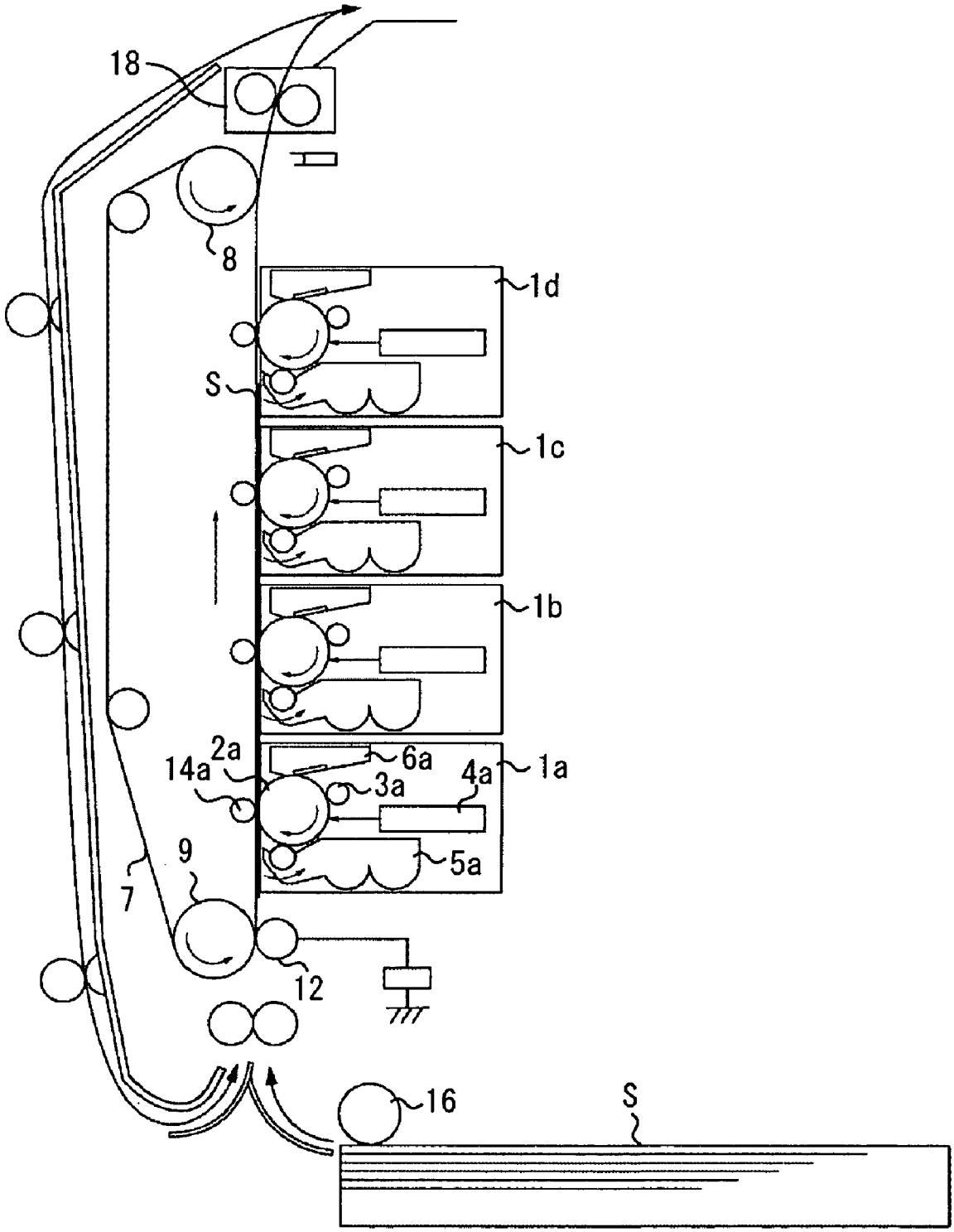
FIG. 7 PRIOR ART
FIG. 7 illustrates an example of a structure of a conventional image forming apparatus.

In the above exemplary embodiments, the electric discharge device is disposed between a transfer position and a fixing device as an example. However, the present invention is also applicable to an electric discharge device that discharges electricity to a transfer material at another position and to another portion of the apparatus. As illustrated in FIG. 6, an electric discharge device having a discharge electrode of a wire 43 disposed in a shield electrode 44 can be used in place of the electric discharge device 22 described above.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-276407 filed Oct. 24, 2007, which is hereby incorporated by reference herein in its entirety.

What is claimed is:

1. An image forming apparatus comprising:

an image bearing member for bearing an unfixed toner image;

a transfer unit configured to transfer the unfixed toner image onto a transfer material from the image bearing member;

a fixing unit configured to fix the unfixed toner image on the transfer material;

a conveying belt configured to convey the transfer material from the transfer unit to the fixing unit; and an electric discharge unit configured to perform electric discharge to the transfer material, wherein the electric discharge unit includes a discharge electrode, a power circuit capable of applying a voltage to the discharge electrode and a conductive member disposed at a position opposed to the discharge electrode which is configured to assist electric discharge of the discharge electrode, and is provided on a side of a surface of the transfer material on which the unfixed toner image is carried, between the transfer unit and a position at which the transfer material separates from the conveying belt, wherein the power circuit is switchable between a voltage of positive polarity applied to the discharge electrode and a voltage of negative polarity applied to the discharge electrode, and wherein the electric discharge unit further includes a first diode and a second diode, the conductive member is electrically grounded via the first diode, the discharge electrode and the conductive member are connected via the second diode, and terminals of the same polarity in the first diode and the second diode are connected to the conductive member.

2. The image forming apparatus according to claim 1, wherein a charge polarity of the toner is negative and an anode terminal of the first diode and an anode terminal of the second diode are connected to the conductive member.

3. The image forming apparatus according to claim 2, wherein a charge polarity of the toner is negative and a cathode terminal of the first diode and a cathode terminal of the second diode are connected to the conductive member.

4. An image forming apparatus comprising:

an image bearing member for bearing an unfixed toner image;

a transfer unit configured to transfer the unfixed toner image onto a transfer material from the image bearing member;

a fixing unit configured to fix the unfixed toner image on the transfer material;

a conveying belt configured to convey the transfer material from the transfer unit to the fixing unit; and an electric discharge unit configured to perform electric discharge to the transfer material, wherein the electric discharge unit includes a discharge electrode, a power circuit capable of applying a voltage to the discharge electrode, and a conductive member disposed at a position opposed to the discharge electrode which is configured to assist electric discharge of the discharge electrode, and is provided on a side of a surface of the transfer material on which the unfixed toner image is carried, between the transfer unit and a position at which the transfer material separates from the conveying belt, wherein the power circuit is switchable between a voltage of positive polarity applied to the discharge electrode and a voltage of negative polarity applied to the discharge electrode, and wherein the electric discharge unit further includes a first diode and a resistive element, the conductive member is electrically grounded via the first diode, and the discharge electrode and the conductive member are connected via the resistive element.

5. An image forming apparatus comprising:

an image bearing member for bearing an unfixed toner image;

a transfer unit configured to transfer the unfixed toner image onto a transfer material from the image bearing member;

a fixing unit configured to fix the unfixed toner image on the transfer material;

a conveying belt configured to convey the transfer material from the transfer unit to the fixing unit; and an electric discharge unit configured to perform electric discharge to the transfer material, wherein the electric discharge unit includes a discharge electrode, a first power circuit capable of applying a voltage to the discharge electrode, and a conductive member disposed at a position opposed to the discharge electrode which is configured to assist electric discharge of the discharge electrode, and is provided on a side of a surface of the transfer material on which the unfixed toner image is carried, between the transfer unit and a position at which the transfer material separates from the conveying belt, wherein the first power circuit is switchable between a voltage of positive polarity applied to the discharge electrode and a voltage of positive polarity not applied to the discharge electrode, and wherein the electric discharge unit further includes a second power circuit configured to apply a voltage of negative polarity to the conductive member, a constant voltage element and a resistive element, the discharge electrode and the first power circuit are connected via the constant voltage element, and the discharge electrode and the conductive member are connected via the resistive element.

6. An electric discharge device comprising:

a discharge electrode;

a power circuit capable of applying a voltage to the discharge electrode; and a conductive member which is disposed at a position opposed to the discharge electrode configured to assist electric discharge of the discharge electrode, wherein the power circuit is switchable between a voltage of positive polarity applied to the discharge electrode and a voltage of negative polarity applied to the discharge electrode, and wherein the electric discharge device further includes a first diode and a second diode, the conductive member is electrically grounded via the first diode, the discharge electrode and the conductive member are connected via the second diode, and terminals of the same polarity in the first diode and the second diode are connected to the conductive member.

* * * * *